US006749400B2

(12) United States Patent
Dougherty et al.

(10) Patent No.: US 6,749,400 B2
(45) Date of Patent: Jun. 15, 2004

(54) GAS TURBINE ENGINE DISK RIM WITH AXIALLY CUTBACK AND CIRCUMFERENTIALLY SKEWED COOLING AIR SLOTS

(75) Inventors: James Steven Dougherty, Cincinnati, OH (US); Jeffrey Louis Brown, Mason, OH (US); Domingo Resendez Barrera, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 102 days.

(21) Appl. No.: 10/231,420

(22) Filed: Aug. 29, 2002

(65) Prior Publication Data

US 2004/0042900 A1 Mar. 4, 2004

(51) Int. Cl.[7] ..... F01D 5/08; F01D 5/18

(52) U.S. Cl. ..... 416/96 R; 416/97 R; 416/220 R; 415/115; 415/174.5

(58) Field of Search ..... 415/115, 174.4, 415/174.5; 416/95, 96 R, 96 A, 97 R, 220 R

(56) References Cited

U.S. PATENT DOCUMENTS 5,143,512 A 9/1992 Corsmeier et al.
5,173,024 A * 12/1992 Mouchel et al. ..... 416/220 R
5,275,534 A 1/1994 Cameron et al.
5,333,993 A * 8/1994 Stueber et al. ..... 415/174.5
5,984,630 A 11/1999 Di Salle et al.
6,331,097 B1 12/2001 Jendrix

OTHER PUBLICATIONS cfm international, CFM56, Illustrated Parts Catalog, 8 pages, dated Jan. 15, 1999.

* cited by examiner

*Primary Examiner*—Christopher Verdier
(74) *Attorney, Agent, or Firm*—Nathan D. Herkamp; Steven J. Rosen

(57) ABSTRACT

A gas turbine engine rotor disk assembly includes a disk having an annular hub circumscribed about a centerline. An annular web extends radially outwardly from the hub to an annular rim. A plurality of dovetail slots extend generally axially through the rim. A plurality of cooling air slots extending generally radially through the rim and are skewed circumferentially with respect to the centerline and slanted axially aftwardly with respect to a normal radius perpendicular to the centerline. In the exemplary embodiment, each cooling air slot has parallel side walls skewed circumferentially with respect to the centerline and an aft wall extending between the side walls and slanted axially aftwardly with respect to the normal radius. The side walls are skewed circumferentially about 5 degrees with respect to the centerline and the aft wall is slanted axially aftwardly about 18 degrees with respect to the normal radius.

25 Claims, 4 Drawing Sheets

GAS TURBINE ENGINE DISK RIM WITH AXIALLY CUTBACK AND CIRCUMFERENTIALLY SKEWED COOLING AIR SLOTS

TECHNICAL FIELD

This invention relates to cooling of turbine rotor disks and blades of gas turbine engines with cooling air supplied to a dovetail slot which retains a blade root in a rim of a rotating turbine disk and, in particular, to a cooling air slot which directs cooling air to the dovetail slot.

BACKGROUND OF THE INVENTION

In gas turbine engines, fuel is burned within a combustion chamber to produce hot gases of combustion. The gases are expanded within a turbine section producing a gas stream across alternating rows of stationary stator vanes and turbine rotor blades to produce usable power. Gas stream temperatures at the initial rows of vanes and blades commonly exceed 2,000 degrees Fahrenheit. Blades and vanes, susceptible to damage by the hot gas stream, are cooled by air compressed upstream within the engine and flowed to the turbine components. One technique for cooling rotating turbine disk assemblies, having blades attached to rims of disks, injects cooling air from stationary cavities within the engine to a disk assembly for distribution to the interior of the turbine blades. A cooling air injection nozzle is a well-known device used to receive compressed air from a compressor of the engine and inject the cooling air through circumferentially spaced passages that impart a swirling movement and directs an injected stream of the cooling air tangentially to the rotating turbine disk assembly. A typical turbine disk assembly has the turbine blades attached to the rims of the disk and a disk side plate attached to a forward or aft face of the disk forming a cooling air passage between the plate and the disk. The plate also is used to axially retain the blades in dovetail slots in the rim of the disk and to support one or more rotating seals. In order to perform these functions, the disk side plate is usually restrained axially and supported radially by the disk out near the rim or on the web, where the stress fields are typically high. In the case where a disk side plate supports inner and outer rotating seals, or where the outer section of the disk side plate requires more radial support, a means of axial retention and radial support may be required at a lower radially inner position of the disk also.

The dovetail slots are circumferentially disposed between posts of the rims. Cooling air flows through radially extending cooling air slots in the rim between the posts or between blade retainer flanges of the posts. The cooling air slots extend to the dovetail slots and thus direct cooling air into the dovetail slots through which cooling air passages in the turbine blades receive the cooling air. The cooling air slots are usually milled in the disk rim and into a hoop stress path of the disk. Stress increases in this region significantly impacts the overall life of the part due to low cycle fatigue. Due to the high stress concentrations seen in this area, the cooling air slot shape is extremely sensitive to small variations in depth, radius, position and its overall alignment to the stress field.

The air slot is typically manufactured by milling a straight slot cut in the radial direction. Such a cooling air slot design has stress peaks in a fillet face, top and bottom breakout locations, and a dovetail slot bottom break-edge. It is undesirable to have the stress peak in the fillet face or the breakout locations, because these locations are hard to measure and control in the manufacturing process. This may lead to a non-robust design because it is very sensitive to slight manufacturing variations. Also, the high peak stress in these areas leads to a low life due to low cycle fatigue.

In some engines, the cooling air slot may be the life limiting feature of the part. By way of example, the CFM56-5B, -5C and -7 engines models have several calculated life limiting features in the HPT disk. It is desirable to increase the life limit to perhaps 20,000 cycles or more in such an engine. It is highly desirable to have a cooling air slot design with improved durability and one which provides a substantial increase in the overall life of the slot and lowers susceptibility to low cycle fatigue.

SUMMARY OF THE INVENTION

A gas turbine engine rotor disk assembly includes a disk having an annular hub circumscribed about a centerline. The disk has an annular web extending radially outwardly from the hub and an annular rim is disposed on a radially outer end of the web. A plurality of dovetail slots extend generally axially through the rim. A plurality of cooling air slots extend generally radially through the rim and are skewed circumferentially with respect to the centerline and slanted axially aftwardly with respect to a normal radius perpendicular to the centerline.

In the exemplary embodiment illustrated herein, each cooling air slot has parallel side walls skewed circumferentially with respect to the centerline and an aft wall extending between the side walls and slanted axially aftwardly with respect to the normal radius which is perpendicular to the centerline. A fillet is formed between each of side walls and the aft wall. Each fillet has a fillet radius of curvature. The aft wall is curved and has a wall radius of curvature. The wall radius is about equal to a width of the cooling air slot between side walls. The wall radius of curvature is about four times larger than the fillet radius of curvature. The side walls are skewed circumferentially about 5 degrees with respect to the centerline and the aft wall is slanted axially aftwardly about 18 degrees with respect to the normal radius which is perpendicular to the centerline.

The axially cutback and circumferentially skewed cooling air slot lowers the stress in the air slot to reduce low cycle fatigue and improve the overall life of the disk. The axially cutback and circumferentially skewed cooling air slot can provide a more robust design due to a decrease in sensitivity to manufacturing variation by shifting the stress peak to the aft wall of the air slot.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
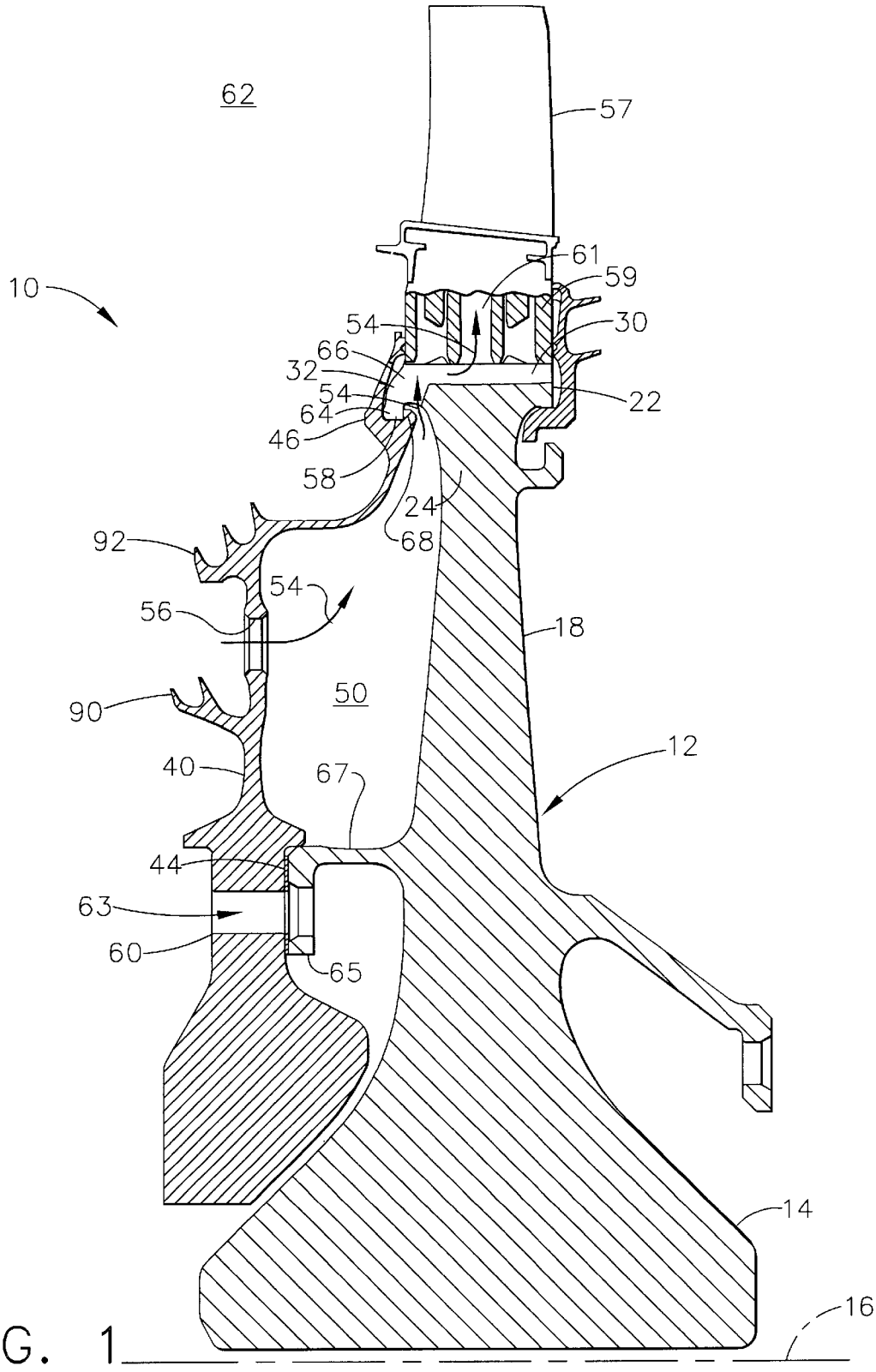
FIG. 1 is a fragmentary axial cross-sectional view illustration of a portion of the turbine section of a gas turbine engine having an exemplary embodiment of a turbine disk with cooling air slots skewed circumferentially and slanted axially aftwardly.
Figure 2:
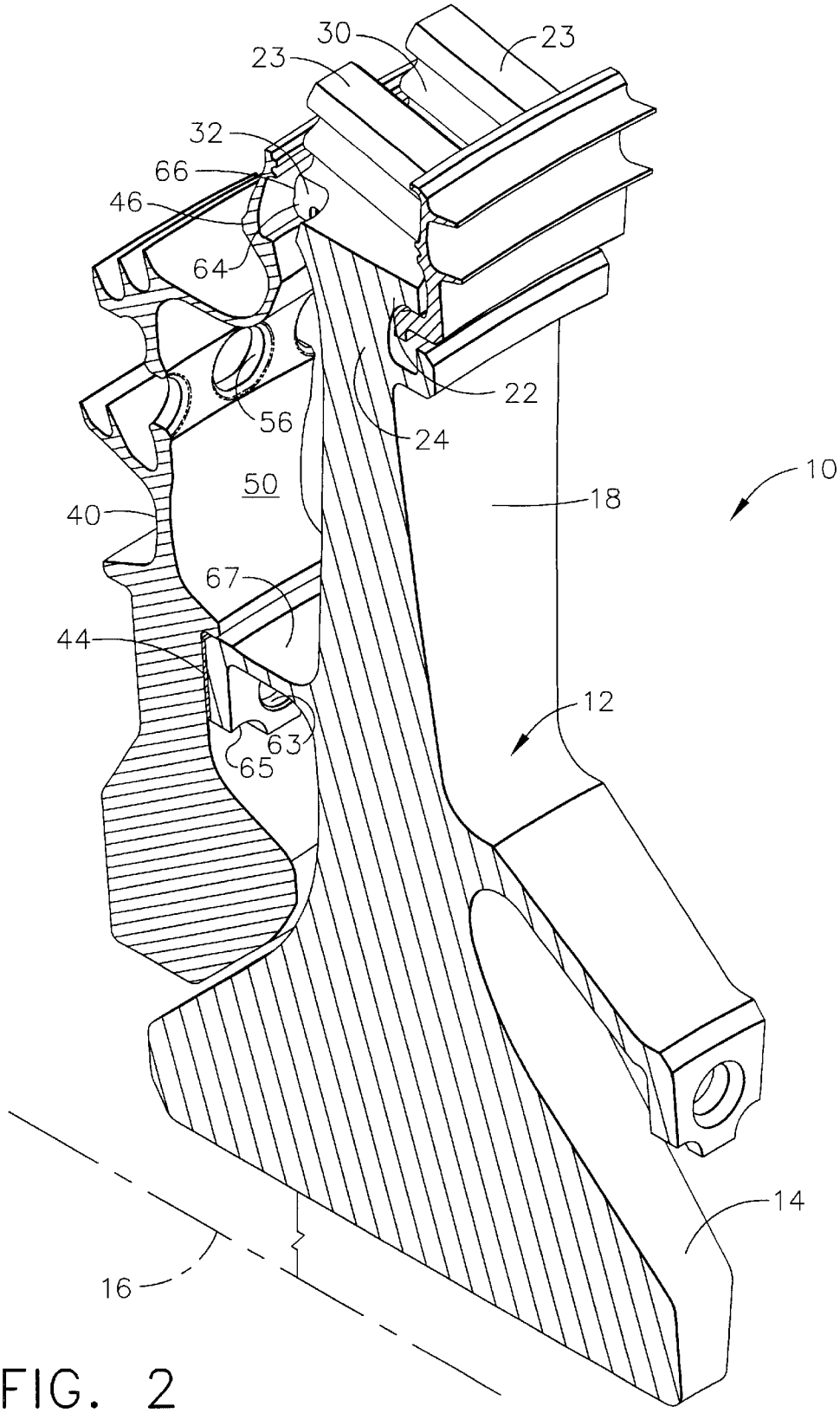
FIG. 2 is a perspective view illustration of a sector of the turbine disk illustrated in FIG. 1.

Illustrated in FIGS. 1 and 2 is an exemplary embodiment of a disk 12 in a gas turbine engine rotor disk assembly 10. The disk 12 includes an annular hub 14 circumscribed about a centerline 16. An annular web 18 extends radially outwardly from the hub 14 and an annular rim 22 is disposed on a radially outer end 24 of the web. The rim 22 extends axially aftwardly and forwardly beyond the web 18. A plurality of dovetail slots 30 extend generally axially through the rim 22 forming disk posts 23 therebetween. A plurality of cooling air slots 32 extend generally radially through the rim 22 forward of the web 18 and are skewed circumferentially with respect to the centerline 16 as illustrated in FIGS. 3, 4, and 5 and slanted axially aftwardly along their entireties with respect to a normal radius NR perpendicular to the centerline 16 as illustrated in FIG. 5.

Figure 3:
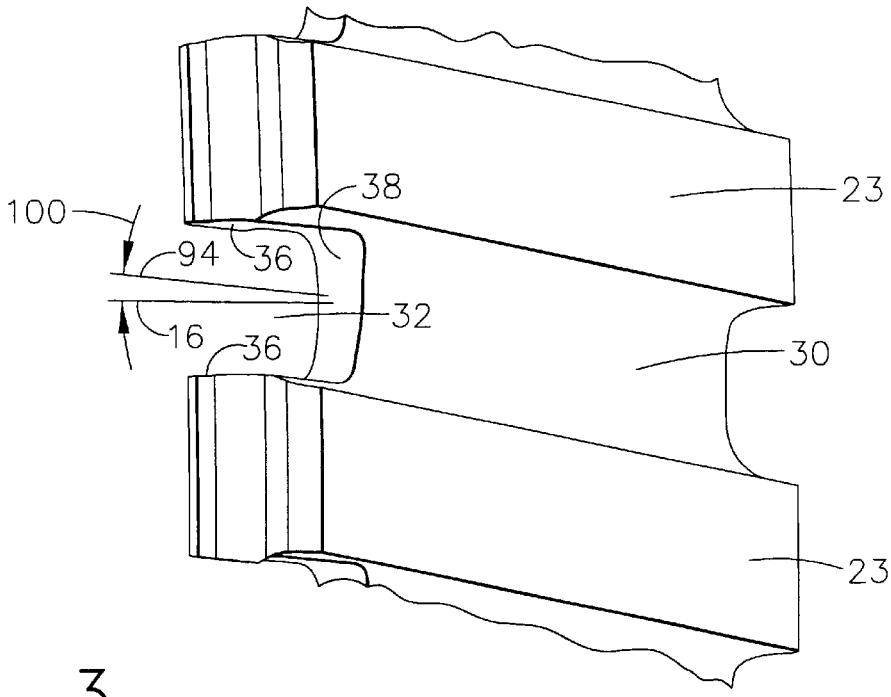
FIG. 3 is a radially inwardly looking perspective view illustration of a portion of a rim of the turbine disk portion illustrated in FIG. 2.
Figure 4:
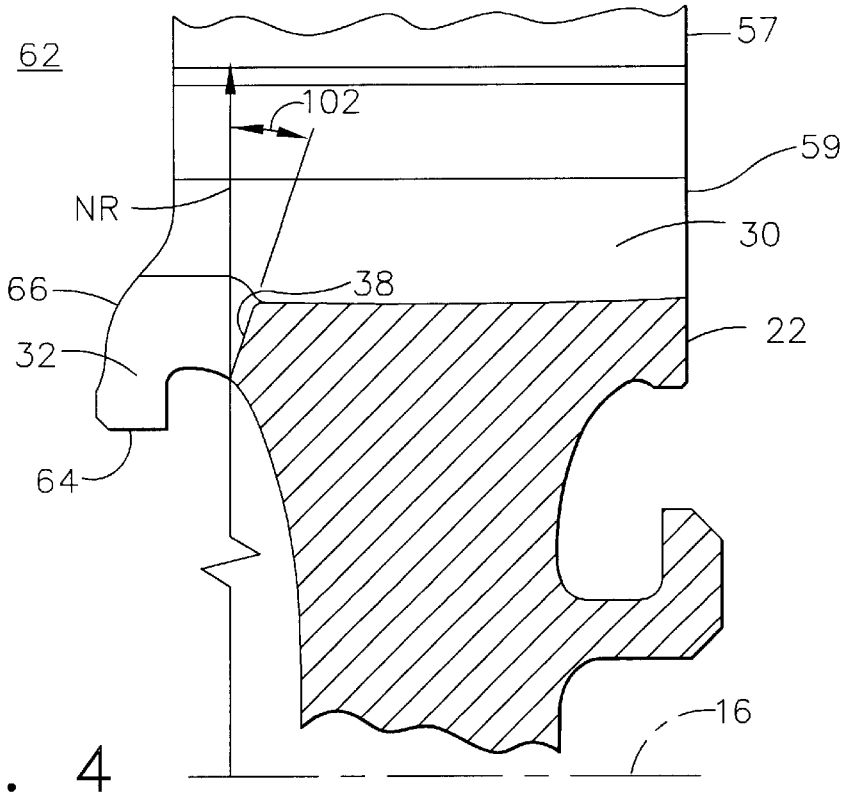
FIG. 4 is an enlarged axial cross-sectional view illustration of the rim of the disk illustrated in FIG. 1.
Figure 5:
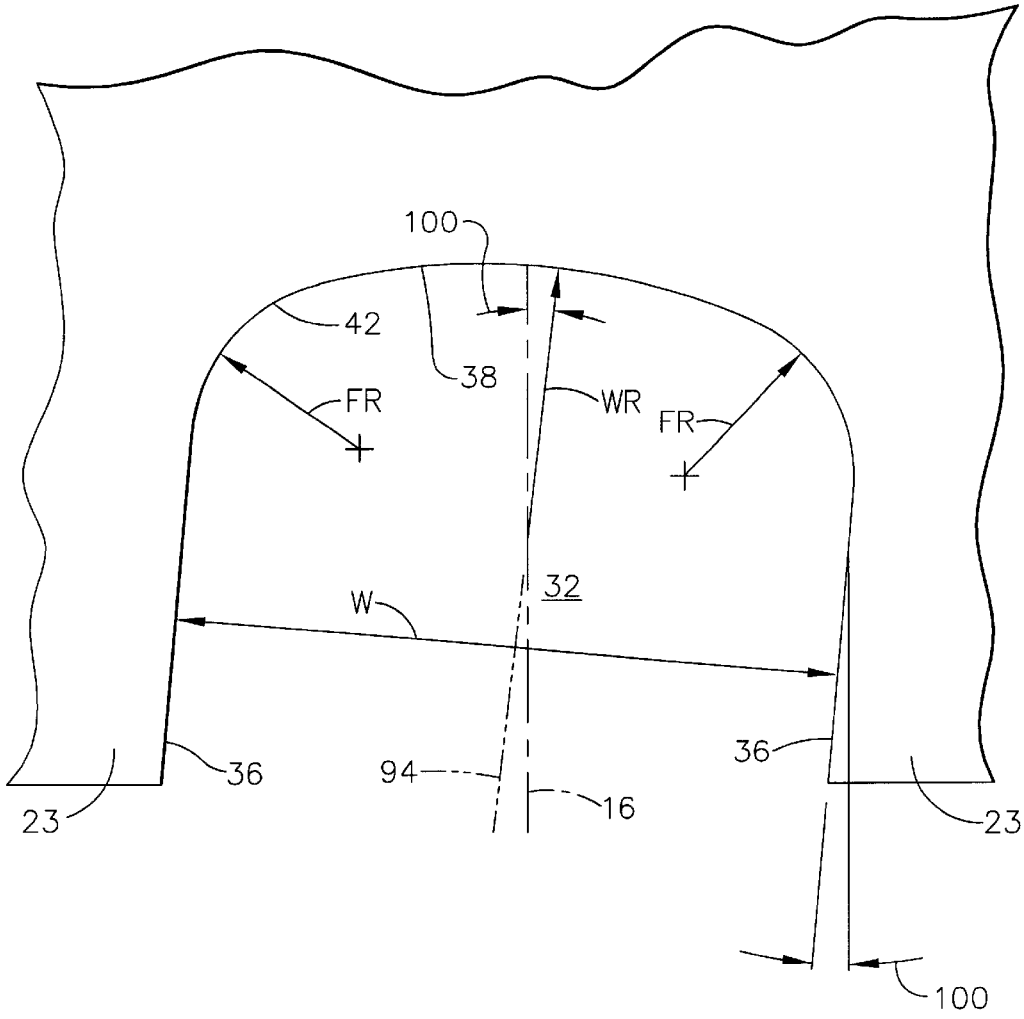
FIG. 5 is a radially inwardly looking top view illustration of one of the cooling air slots illustrated in FIG. 3.

Illustrated in FIGS. 3, 4 and 5 is an exemplary embodiment of one of the cooling air slots 32 having parallel side walls 36 skewed circumferentially with respect to the centerline 16 as illustrated by skew angle 100 between a mid-line 94 of the cooling air slot 32 and the centerline 16. An aft wall 38 extending between the side walls is slanted axially aftwardly with respect to the normal radius NR which is perpendicular to the centerline as illustrated by a slant angle 102 between the aft wall 38 and the normal radius NR as illustrated in FIG. 4. A fillet 42 is formed between each of side walls 36 and the aft wall 38. Each fillet 42 has a fillet radius of curvature FR. The aft wall 38 is curved and has a wall radius of curvature WR.

In the exemplary embodiment illustrated herein, the cooling air slots 32 and the side walls 36 are skewed circumferentially at a skew angle 100 of about 5 degrees, with respect to the centerline 16. The aft wall 38 is slanted axially aftwardly at a slant angle 102 of about 18 degrees, with respect to the normal radius NR which is perpendicular to the centerline 16. The wall radius WR is about equal to a width W of the cooling air slot 32 between side walls 36. The wall radius of curvature WR is about four times larger than the fillet radius of curvature FR.

Referring again to FIGS. 1 and 2, the disk 12 is designed for use in a gas turbine engine rotor disk assembly 10 which includes the disk and an annular face plate 40 disposed axially forward of the web 18. The annular face plate 40 engages and seals against the disk 12 at radially spaced apart radial inner and outer locations 44 and 46 of the assembly forming an annular flow passage 50 between the disk and the plate between the locations. Cooling air 54 enters the flow passage 50 through holes 56 in the plate 40 and flows radially outward towards the rim 22. A bayonet connection 58 secures the plate 40 to the disk 12 at the outer location 46. A bolted connection 60, indicated by bolt holes 63 in the plate 40 and a flange 65 of an extension 67 of the disk 12, secures the plate 40 to the disk 12 at the inner location 44.

The bayonet connection 58 includes rim tabs 64 (also see FIG. 4) circumferentially disposed around the rim 22 and extending radially inwardly from a forward end 66 of the rim. The cooling air slots 32 extend between at least some of the rim tabs 64. Plate tabs 68 extend radially outwardly from the plate 40 at the outer location 46. During assembly, the plate 40 is turned engaging the plate tabs 68 with the rim tabs 64 securing the plate to the disk 12. Radially inner and outer seal teeth 90 and 92 extend radially inwardly from locations radially inwardly and outwardly of the holes 56 in the plate 40.

The cooling air slots 32 provide a fluid passageway for the cooling air 54 to flow from the annular flow passage 50 to the dovetail slots 30 from where it is supplied to turbine blades 57 disposed across a turbine flowpath 62. The turbine blades 57 are mounted by dovetail roots 59 in the dovetail slots 30. The cooling air slots 32 provide radial pumping of the cooling air 54 due to centrifugal force from the annular flow passage 50 to the dovetail slots 30. The cooling air 54 flows from the dovetail slots 30 through cooling air passages 61 in the blades 57 and is exhausted in the turbine flowpath 62. A pressure differential between cooling air passage 61 and the turbine flowpath 62, across which the blades 57 are disposed, provides additional flow of the cooling air 54 from the annular flow passage 50 to the dovetail slots 30.

The axially cutback and circumferentially skewed cooling air slot lowers the stress in the air slot to reduce low cycle fatigue and improve the overall life of the disk. The axially cutback and circumferentially skewed cooling air slot can provide a more robust design due to a decrease in sensitivity to manufacturing variation by shifting the stress peak to the aft wall of the air slot.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A gas turbine engine rotor disk comprising:

an annular hub circumscribed about a centerline;

an annular web extending radially outwardly from said hub;

an annular rim disposed on a radially outer end of said web;

a plurality of dovetail slots extending generally axially through said rim;

a plurality of cooling air slots extending generally radially through said rim; and said cooling air slots skewed circumferentially with respect to said centerline and slanted axially aftwardly along their entireties with respect to a normal radius perpendicular to said centerline.

2. A disk as claimed in claim 1 wherein each of said cooling air slots includes parallel side walls skewed circumferentially with respect to said centerline and an aft wall extending between said side walls and slanted axially aftwardly with respect to said normal radius to said centerline.

3. A disk as claimed in claim 2, further comprising:

a fillet between each of said side walls and said aft wall, each fillet having a fillet radius of curvature, said aft wall being curved and having a wall radius of curvature, and said wall radius of curvature being about equal to a width of said cooling air slot between side walls.

4. A disk as claimed in claim 3 wherein said wall radius of curvature is about four times larger than said fillet radius of curvature.

5. A disk as claimed in claim 4 wherein said side walls are skewed circumferentially about 5 degrees with respect to said centerline and said aft wall is slanted axially aftwardly about 18 degrees with respect to said normal radius to said centerline.

6. A disk as claimed in claim 3 wherein said side walls are skewed circumferentially about 5 degrees with respect to said centerline and said aft wall is slanted axially aftwardly about 18 degrees with respect to said normal radius to said centerline.

7. A disk as claimed in claim 2 wherein said side walls are skewed circumferentially about 5 degrees with respect to said centerline and said aft wall is slanted axially aftwardly about 18 degrees with respect to said normal radius to said centerline.

8. A disk as claimed in claim 2 further comprising: rim tabs circumferentially disposed around said rim and extending radially inwardly from a forward end of said rim, and said cooling air slots extending between at least some of said rim tabs.

9. A disk as claimed in claim 8, further comprising:

a fillet between each of said side walls and said aft wall, each fillet having a fillet radius of curvature, said aft wall being curved and having a wall radius of curvature, and said wall radius of curvature being about equal to a width of said cooling air slot between side walls.

10. A disk as claimed in claim 9 wherein said wall radius of curvature is about four times larger than said fillet radius of curvature.

11. A disk as claimed in claim 10 wherein said side walls are skewed circumferentially about 5 degrees with respect to said centerline and said aft wall is slanted axially aftwardly about 18 degrees with respect to said normal radius to said centerline.

12. A gas turbine engine rotor disk assembly comprising:

a disk having an annular hub circumscribed about a centerline;

an annular web extending radially outwardly from said hub;

an annular rim disposed on a radially outer end of said web;

a plurality of dovetail slots extending generally axially through said rim;

a plurality of cooling air slots extending generally radially through said rim;

said cooling air slots skewed circumferentially with respect to said centerline and slanted axially aftwardly along their entireties with respect to a normal radius perpendicular to said centerline, and an annular face plate disposed axially forward of said web and engaging said disk at radially spaced apart radial inner and outer locations of the assembly forming an annular flow passage between said disk and said plate between said locations.

13. An assembly as claimed in claim 12 further comprising a bayonet connection between said disk and plate at said outer location.

14. An assembly as claimed in claim 13 further comprising a bolted connection between said disk and plate at said inner location.

15. An assembly as claimed in claim 14 further comprising:

rim tabs circumferentially disposed around said rim and extending radially inwardly from a forward end of said rim, said cooling air slots extending between at least some of said rim tabs, and plate tabs extending radially outwardly from said plate at said outer location.

16. An assembly as claimed in claim 14 wherein each of said cooling air slots further includes parallel side walls skewed circumferentially with respect to said centerline and an aft wall extending between said side walls and slanted axially aftwardly with respect to said normal radius to said centerline.

17. An assembly as claimed in claim 16, further comprising:

a fillet between each of said side walls and said aft wall, each fillet having a fillet radius of curvature, said aft wall being curved and having a wall radius of curvature, and said wall radius of curvature being about equal to a width of said cooling air slot between side walls.

18. An assembly as claimed in claim 17 wherein said wall radius of curvature is about four times larger than said fillet radius of curvature.

19. An assembly as claimed in claim 18 wherein said side walls are skewed circumferentially about 5 degrees with respect to said centerline and said aft wall is slanted axially aftwardly about 18 degrees with respect to said normal radius to said centerline.

20. An assembly as claimed in claim 17 wherein said side walls are skewed circumferentially about 5 degrees with respect to said centerline and said aft wall is slanted axially aftwardly about 18 degrees with respect to said normal radius to said centerline.

21. An assembly as claimed in claim 16 wherein said side walls are skewed circumferentially about 5 degrees with respect to said centerline and said aft wall is slanted axially aftwardly about 18 degrees with respect to said normal radius to said centerline.

22. An assembly as claimed in claim 16 wherein said bayonet connection further comprises:

rim tabs circumferentially disposed around said rim and extending radially inwardly from a forward end of said rim, said cooling air slots extending between at least some of said rim tabs, and plate tabs extending radially outwardly from said plate at said outer location.

23. An assembly as claimed in claim 22, further comprising:

a fillet between each of said side walls and said aft wall, each fillet having a fillet radius of curvature, said aft wall being curved and having a wall radius of curvature, and said wall radius of curvature being about equal to a width of said cooling air slot between side walls.

24. An assembly as claimed in claim 23 wherein said wall radius of curvature is about four times larger than said fillet radius of curvature.

25. An assembly as claimed in claim 24 wherein said side walls are skewed circumferentially about 5 degrees with respect to said centerline and said aft wall is slanted axially aftwardly about 18 degrees with respect to said normal radius to said centerline.

* * * * *